United States Patent [19]

Olsen

[11] 4,040,377

[45] Aug. 9, 1977

[54] MOORING WHIP BASE

[76] Inventor: Robert H. Olsen, 106 SE. 10th St., Fort Lauderdale, Fla. 33316

[21] Appl. No.: 702,468

[22] Filed: July 6, 1976

[51] Int. Cl.[2] ..... B63B 21/08

[52] U.S. Cl. ..... 114/230

[58] Field of Search ..... 114/230, 221 R; 248/160, 371, 398

[56] References Cited

U.S. PATENT DOCUMENTS

| | | | |
|---|---|---|---|
| 2,996,033 | 8/1961 | Yordi | 114/230 |
| 3,120,831 | 2/1964 | Fulton | 114/230 |
| 3,187,707 | 6/1965 | Carbone | 114/230 |

*Primary Examiner*—Trygve M. Blix
*Assistant Examiner*—Stuart M. Goldstein
*Attorney, Agent, or Firm*—Malin & Haley

[57] ABSTRACT

An improved mooring whip base for securely anchoring a mooring whip to a dock, seawall or other suitable foundation to prevent contact of a moored vessel with the dock. The device includes a pivotal housing having a receptacle for receiving the base end of a mooring whip and a lever arm protruding from the housing that is resiliently biased to a base plate with a solid rubber cylinder. The device provides increased resistive force to prevent vessel damage and increased reliability.

5 Claims, 5 Drawing Figures

MOORING WHIP BASE

BACKGROUND OF THE INVENTION

This invention relates generally to a base for securing a mooring whip to a permanent foundation, and more particularly to an improved mooring whip base which allows for greater operational efficiency with increased durability of the mooring whip.

Mooring whips have been utilized in the past to prevent a moored vessel from striking a dock, seawall, or the like by providing a positive force on the vessel directed away from the mooring site. The mooring whip acts as a spring to offset forces which would tend to force the vessel against the mooring side. However, the mooring whip base which secures the whip to the dock or pier or seawall must itself provide resilient force to allow the mooring whip to accomodate various movements of the vessel from wind force, tidal changes and wave action.

The prior art shows a mooring whip in U.S. Pat. No. 3,120,831, issued to Fulton, which has a complicated construction and uses resilient bushings and sleeves to provide resilient pivotal movement of the mooring whip. Another U.S. Pat. No. 3,187,707, issued to Carbone, shows a mooring whip anchoring means which uses a coiled spring for movement of the whip. The attachment of the whip and the spring itself which can be deformed plus the lack of limiting force in the direction of the whip movement as shown in these patents results in premature failure of the mooring whip base. Further extraordinary or abnormal forces experienced by the vessel could seriously over tension the mooring bases shown in the prior art, allowing vessel contact with the dock.

The instant invention overcomes the problems experienced in the prior art and provides a more resistive mooring whip base by mounting a strong, resilient member along the line of movement of the mooring whip apart from the mooring whip receptacle housing. Displacement of the resilient means from the housing allows for the trunion housing and the mooring whip receptacle housing to pivot unencumbered relative to each other to permit enlarged structural members.

BRIEF DESCRIPTION OF THE INVENTION

A mooring whip base for anchoring one end of the mooring whip to a rigid foundation such as a dock, seawall, pier or the like having a rigid base plate, a rigid housing having a hollow, cylindrical receptacle for receiving the base end of a mooring whip, a means for securing the mooring whip base end within the hollow, cylindrical receptacle of the housing, a trunnion mount integrally formed and connected to the upper surface of the base plate, a trunnion disposed through said whip receiving housing and connected into the trunnion mount which allows the cylindrical housing to pivot in one plane. Disposed from the upper exterior surface of the whip housing is a protruding lever arm disposed in the direction of pivotal movement. With the whip housing receptacle axis disposed vertically, the lever arm is substantially perpendicular to the longitudinal axis of the housing. A resilient means is secured between the bottom surface of the protruding lever arm and the upper surface of the base plate in close proximity to the housing. In one embodiment, the resilient means is a hard, rubber cylinder with its cylindrical axis being substantially parallel to the housing receptacle axis when the housing receptacle axis is in the upright vertical position. The resilient means may be affixed to the lever arm and the base plate by threaded connectors. The base plate also includes a pair of apertures which receive ground bolts or anchors for securing the base plate to a concrete or other type of foundation. The mooring whip base is mounted such that the resilient means is disposed towards the moored vessel.

The pivotal motion on the housing will be transmitted as a compression force against the rubber cylinder which acts to hold the housing receptacle in a vertical upright position.

The lower section of the housing which receives the trunnion has an enlarged thickness to provide increased strength and durability to the entire pivotal connection. In one embodiment the base plate includes a threaded aperture which receives a threaded stud projecting therefrom to mount the resilient member at one end to the upper surface of the plate. A bolt is disposed through the lever arm which is received into a nut firmly attached to the upper ends of the resilient member.

It is an object of this invention to provide an improved mooring whip base for securely anchoring a mooring whip to a dock, pier, seawall or the like.

It is another object of this invention to provide an improved mooring whip base which has increased reliability and improves the protection of the vessel by keeping it away from the seawall or pier with increased levered, resilient force.

And yet still another object of this invention to provide an improved mooring whip base having improved resilient force generating means for safer vessel mooring.

In accordance with these and other object which will be apparent hereinafter, the instant invention will now be described with particular reference to the accompanying drawings.

PREFERRED EMBODIMENT OF THE INVENTION

Figure 1:
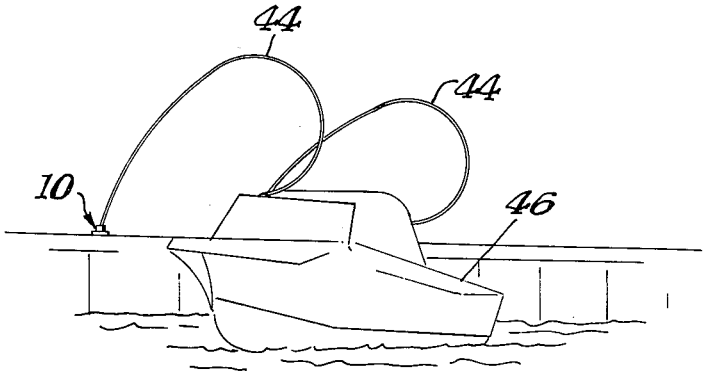
FIG. 1 shows a perspective view of a vessel moored utilizing a mooring whip and mooring whip base.

Referring now to the drawings and specifically to FIG. 1, a conventional vessel 46 is shown adjacent a sea wall and is held away from the sea wall by a pair of mooring whips 44 which are anchored to the seawall by a mooring whip base 10 constructed in accordance with the instant invention. The mooring whips 44 are conventional and do not form part of the instant invention.

Figure 2:
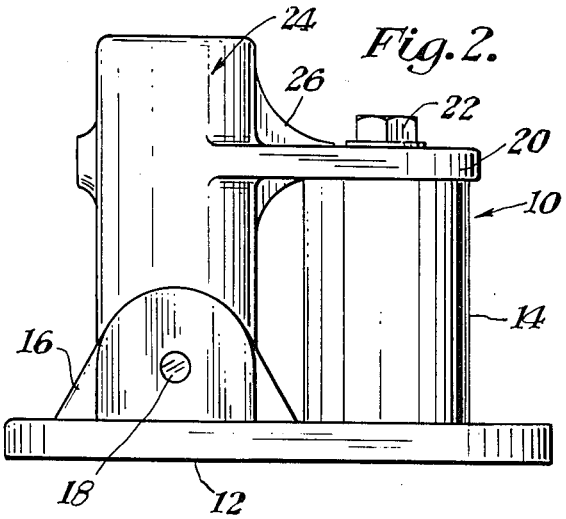
FIG. 2 shows a side elevational view of the instant invention.

FIG. 2 shows the instant invention 10 which is a mooring whip base having a rigid base plate 12 which affixes the mooring whip to a permanent foundation, the base plate 12 having integrally formed therewith a pair of raised trunnion mounts 16. The trunnion mount 16 receives a trunnion 18 which is mounted through the mooring whip receptacle housing 24 which is a cylindrical housing having a hollow receptacle 30 which receives the anchored end of the mooring whip. A rigid lever arm 20 which is formed integrally with housing 24 is perpendicular to the cylindrical axis of the housing 24 and protrudes from one side of the housing. A resilient member 14 is affixed between the lower surface of lever arm 20 and the upper surface of plate 12. In operation, with a mooring whip end affixed within the housing receptacle 30, the housing will pivot, transmitting a compression force downwardly on arm 20 against the resilient member 14. Thus the housing 24 pivots in the plane of the resilient member and the lever arm 20. The resilient member 14 applys an upward force tending to keep the housing 24 in a vertical orientation as shown in FIG. 2.

Figure 3:
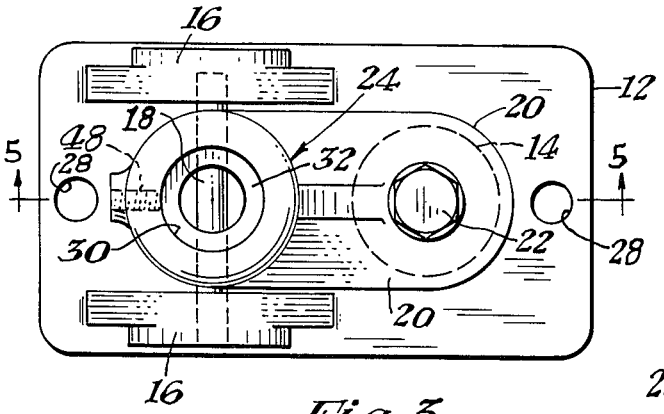
FIG. 3 shows a top plan view of the instant invention.

FIG. 3 shows the housing 24 including a cylindrical, hollow receptacle 30 which is sized in diameter to accomodate the anchored end of a conventional mooring whip, the depth being sufficient to receive the end portion of the whip. An annular rim 32 is shown, against which the end of the mooring whip rests and includes a thicker base portion of the housing through which trunnion 18 is disposed. The housing 24 has a thicker base portion for receiving a trunnion for increased strength. The housing 24 is pivotal about the trunnion. A locking screw 48 is mounted through the side of the housing which engages a mooring whip end disposed within the housing receptacle for firmly locking it in the housing. A pair of apertures 28 disposed through the base plate 12 receive anchoring bolts or fasteners for mounting the device to the sea wall, pier, dock or the like.

Figure 4:
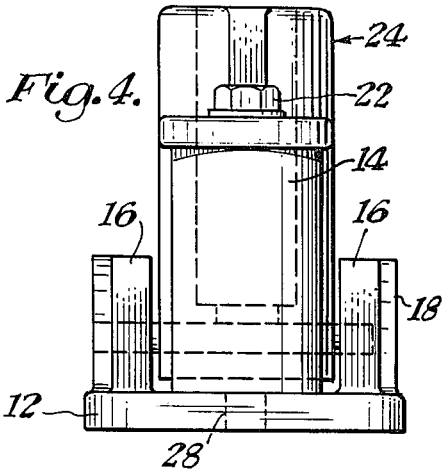
FIG. 4 shows a front elevational view looking towards the resilient member of the instant invention.

FIG. 4 shows the trunnion mount 16 disposed on each side of plate 12 which receives the trunnion 18 to allow pivotal motion of the housing 24. The housing pivots in a plane through the reslient member 14 which may be constructed of a hard rubber or the like.

Figure 5:
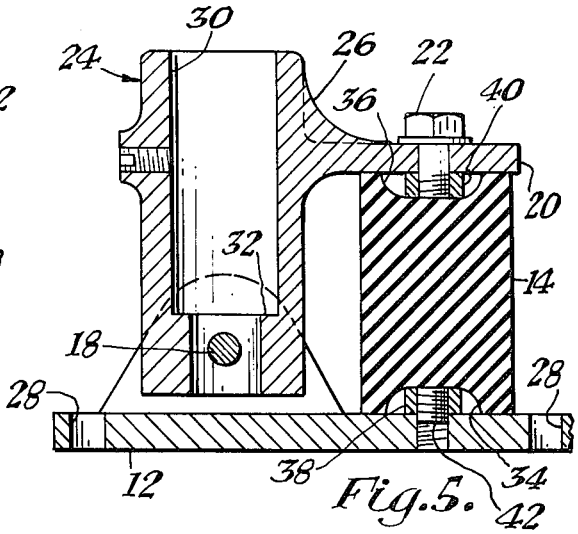
FIG. 5 shows a side elevational view partially in cross-section of the instant invention.

Referring now to FIG. 5, the resilient member 14 has a pair of threaded nuts 38 and 40 rigidly attached at its lower and upper face respectively. The lower nut 38 is threadedly attached to fastener 42 which is also coupled to plate 12, firmly attaching the lower end of resilient member 14 to the upper portion of the base plate. The housing arm 20 likewise is attached to the upper end face of resilient member 14 by a fastener 22 which is received through an aperture within the arm 20 and threadedly connected to nut 40. Thus the resilient member 14 is firmly affixed between arm 20 and base plate 12. FIG. 5 also shows the enlarged thickness including the annular rim 32 disposed in the lower segment of housing 24 which receives trunnion 18. An additional structural ridge 26 disposed along the upper center line of arm 20 increases the structural attachment along the arm 20. The housing 24 and arm 20 are molded as a unitary piece as is the base plate 12 and trunnion mount 16.

The base plate, trunnion housing, mooring whip base housing and arm molded with a non-corrosive aluminum alloy. The resilient member may be constructed of a hard rubber or other comparable resilient material.

In operation a conventional mooring whip is anchored at one end within end the hollow portion of the housing 24 and is firmly locked in place by the set screw 48. The opposite end of the mooring whip is then attached to the boat, which provides a pivotal force when attached to the boat which is resiliently biased by the resilient member 14. The mooring whip base is anchored such that the resilient member is disposed in the direction of the vessel. Forces on the vessel tending to push the vessel inwardly toward the sea wall or pier will cause increased resilient downward compression forces on arm 20 which will be resisted by the resilient member 14. Arm 20 being disposed away from the center line of the housing which receives the mooring whip end allows an increased moment of force disposed on the housing by the resilient member which tends to upright and keep the housing receptacle vertical.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A mooring whip base for anchoring a mooring whip to a dock or the like comprising:

a base plate;

a housing for receiving one end of a mooring whip, said housing including a wall forming a hollow receptacle for receiving said mooring whip end;

means connected directly to said base plate and to said housing for pivoting said housing relative to said base plate said housing being pivotable about a horizontal axis entending through the housing;

a substantially planar lever arm connected to and protruding from the outside of said housing at a point intermediate the ends of the housing; and a resilient means disposed between said lever arm and said base plate and connected to said base plate and said lever arm.

2. A mooring whip base as in claim 1, wherein:

said resilient means includes a solid rubber cylinder.

3. A mooring whip base, as in claim 1, wherein:

said housing includes a base portion having a thickness greater than the hollow receptacle wall;

said base plate connection means comprising a trunnion disposed through said base housing portion; and a trunnion housing mounted on said base plate connected to said trunnion.

4. A mooring whip base as in claim 3, wherein:

said resilient member includes a first threadable fastener connected at one end and a second threadable fastener connected at its opposite end;

a first fastening means connected through said lever arm to said first threaded fastener on said resilient member; and a second fastening means connecting said second threadable fastener to said base plate.

5. A device as in claim 4, wherein:

said housing and said lever arm are of unitary construction.

* * * * *